US005185091A

United States Patent [19]

Ogake et al.

[11] Patent Number: 5,185,091

[45] Date of Patent: Feb. 9, 1993

[54] GREASY OIL AND FAT COMPOSITION FOR FOOD PROCESSING MACHINES

[75] Inventors: Ryoji Ogake, Yachimata; Mitsuo Okada, Yokohama; Hiroyuki Takashima, Yamato; Teruo Shimizu, Omiya; Narihito Yamamoto, Saitama; Hiroyuki Uenoyama, Tokyo, all of Japan

[73] Assignee: Nippon Oil Company Limited, Tokyo, Japan

[21] Appl. No.: 789,721

[22] Filed: Nov. 8, 1991

[30] Foreign Application Priority Data

Apr. 12, 1991 [JP] Japan ..... 3-108371

[51] Int. Cl.[5] ..... C10M 105/14

[52] U.S. Cl. ..... 252/56.5; 252/56 R; 252/52 R

[58] Field of Search ..... 252/56 R, 56 S; 426/601, 608, 609, 611

[56] References Cited

U.S. PATENT DOCUMENTS

| | | | |
|---|---|---|---|
| 1,810,555 | 6/1931 | Edmiston | 252/56 R |
| 2,334,239 | 11/1943 | Barnett | 252/56 R |
| 3,579,548 | 5/1971 | Whyte | 252/56 S |
| 4,023,912 | 5/1977 | Mahler | 252/12 |
| 4,753,752 | 6/1988 | Wilhelm | 252/56 R |
| 5,034,144 | 7/1991 | Ohgake et al. | 252/565 |

FOREIGN PATENT DOCUMENTS

| | | |
|---|---|---|
| 0382512 | 8/1990 | European Pat. Off. . |
| 81/03293 | 11/1981 | PCT Int'l Appl. . |

OTHER PUBLICATIONS

Derwent Abstract JP-A-62 106 837.
Derwent Abstract JP-A-56 037 040.
Derwent Abstract JP-A-52 091 786.
Derwent Abstract JP-A-2 173 100.

*Primary Examiner*—Jacqueline Howard
*Assistant Examiner*—Thomas Steinberg
*Attorney, Agent, or Firm*—Millen, White, Zelano and Branigan

[57] ABSTRACT

A greasy oil and fat composition for food processing machines is prepared by mixing a fatty acid ester of polyglycerol, oil and fat for food and glycerol, melting the mixture by heating and kneading the mixture.

The greasy oil and fat composition is safe for food sanitation, has excellent oxidation stability and lubricating properties and is favorably utilized as lubricant for food processing machines.

16 Claims, No Drawings

GREASY OIL AND FAT COMPOSITION FOR FOOD PROCESSING MACHINES

BACKGROUND OF THE INVENTION

1. Field of the Invention

The present invention relates to a novel greasy oil and fat composition for food processing machines. More particularly, the present invention relates to a novel greasy oil and fat composition for food processing machines which is safe for food sanitation, excellent in oxidation stability and lubricating property and favorably utilized as lubricating oil for machines utilized for food processing.

2. Description of the Prior Art

For processing of agricultural products, livestock products, marine products and other materials to prepare food stuffs, various processes, such as selection, classification, grinding, mixing, baking, heating, fermentation, boiling, drying freezing and the like, are generally applied to the material and various kinds of food processing machines are utilized in these processes.

Examples of the machines for processing of agricultural products are machines and tools for collecting leaves from tea plants, rice cleaning machines, flour mills, brewing apparatus for production of sake, soy sauce, miso and like others and machines for production of noodle, bread, cookies, fruit, juice, jam, pickles and like others. Examples of machines for processing of livestock products are machines for processing milk, machines for production of milk products, such as cheese and butter, machines for processing meat and like others. Examples of machines for processing of marine products are machines for processing of fish meat, machines for processing sea weeds and like others. Other examples of the food processing machines are apparatus for production of food additives, natural flavor and pharmaceutical products, such as a vacuum thin layer evaporator and a mixing apparatus.

As lubricant for the food processing machines, grease based on mineral oil is generally utilized. In the grease based on mineral oil, purified mineral oil is used as the base oil and inorganic compounds, such as metal soap of lithium, potassium and sodium, or organic compounds, such as urea derivatives, are dispersed in the base oil as a thickening agent to make the grease semisolid or solid form.

However, when grease based on mineral oil is utilized, it is unavoidable that the grease is scattered or mixed into the foods or the agricultural products through rotating parts of the machines during long operation of the machines and the scattering and mixing of the grease based on mineral oil is not desirable food sanitation.

To avoid problems on environment and human health, grease made only from those materials which are permitted as food and food additives were proposed as following: (1) an industrial lubricating oil of low environmental hazard made from glycerides of fatty acids, fatty acids, silicone resins and 2,6-di-t-butyl-4-methylphenol which are permitted as food or food additives by the food sanitation law (Laid Open Japanese Patent Publication Showa 51-84803); (2) a lubricating oil for food processing machines in which glycerides of saturated fatty acids of 5 to 21 carbon atoms are used as the base oil and fatty acids of 12 to 22 carbon atoms are compounded to the base oil (Laid Open Japanese Patent Publication Heisei 2-209995); and (3) a high viscosity oil and fat composition prepared by transesterification of oils and fats for food and natural wax (Laid Open Japanese Patent Publication Showa 57-67694).

However, the lubricants of (1) and (2) described above can not be utilized as grease because they are liquid at the ambient temperature even though they are safe for food sanitation. The high viscosity oil of (3) described above has a problem that oxidation stability is inferior because soy bean oil and rapeseed oil are used as the materials even though it is safe for food sanitation and very viscous liquid at the ambient temperature.

SUMMARY OF THE INVENTION

The present invention accordingly has the object to provide an greasy oil and fat composition for food processing machines which is highly safe for food sanitation and excellent in oxidation stability.

Thus, the greasy oil and fat composition for food processing machines of the invention is prepared by mixing a fatty acid ester of polyglycerol, oil and fat for food and glycerol, melting the mixture by heating and kneeding the mixture.

Other and further objects, features and advantages of the invention will appear more fully from the following description.

DETAILED DESCRIPTION OF THE INVENTION

The present inventors investigated extensively to prepare greasy oil and fat composition for food processing machines having the favorable characteristics described above and discovered that, when a fatty acid ester of polyglycerol, oil and fat for food and glycerol are mixed, melted by heating and then kneaded, the composition prepared is effective for achieving the object.

Thus, the greasy oil and fat composition for food processing machines of the invention is prepared by mixing a fatty acid ester of polyglycerol, oil and fat for food and glycerol, melting the mixture by heating and kneeding the mixture.

The most important characteristics of the greasy composition of the invention is that it does not flow down during the service period. The greasy composition has to satisfy the requirement for grease in general that the dropping point must be 80° C. or more.

The fatty acid ester of polyglycerol of the invention is preferably an ester of stearic acid which is solid at the ambient temperature, more preferably, a monoester of stearic acid, to satisfy the requirement that the dropping point must be 80° C. or more. Polyglycerols of higher degree of polymerization are preferable as the polyglycerol. However, the maximum degree of polymerization of glycerol in polyglycerol esters of fatty acids which are permitted by the law as food additives is 10 and decaglycerol is most preferable as the polyglycerol. Of course, polyglycerols of degree of polymerization of more than 10 have sufficient quality as the polyglycerol of the invention.

The oil and fat for food are utilized in the composition for the purpose of giving the composition smoothness. As the oil and fat for food, oil and fat of lower melting point are preferable. However, purified rapeseed oil and soy bean oil are not preferable because of insufficient oxidation stability. Oils and fats prepared by hydrogenation of rapeseed oil and soy bean oil to improve the oxidation stability and oils of relatively good oxidation stability, such as palm oil and olive oil, are usually not sufficient enough concerning the oxidation stability. Triglycerides of medium chain saturated fatty acids (MCT) are preferable concerning the oxidation stability. Examples of the medium chain saturated fatty acid are fatty acids of 6 to 10 carbon atoms, such as caproic acid, heptylic acid, caprylic acid, nonylic acid, caprylic acid and the like. The medium chain saturated fatty acid may be utilized either singly or as a combination of two or more kinds as the material of the triglyceride.

In the composition of the invention, the fatty acid ester of polyglycerol, preferably decaglyceryl monostearate, is utilized in an amount in the range from 25 to 43 weight %, preferably from 25 to 35 weight %, the oil and fat for food, preferably MCT, is utilized in an amount in the range from 3 to 25 weight % and glycerol is utilized in an amount in the range from 40 to 67 weight %. When the amount of any of the components is outside of the specified range, the prepared composition tends to have a dropping point of less than 80° C. and is not desirable.

The thickness of the composition can be adjusted by adding propylene glycol or water. However, it is desirable that the amount of addition of propylene glycol is 2 weight % or less based on the amount of the composition because addition of excess amount of propylene glycol causes decrease of the dropping point. It is also desirable that the amount of addition of water is 2 weight % or less based on the amount of the composition because Japanese Industrial Standard requires that the content of water in grease must be 2.0 weight % or less and also because excess addition of water causes change of composition or decrease of lubricating property by evaporation of water and putrefaction of the composition during storage at the ambient temperature.

The composition of the invention can be prepared by mixing a fatty acid ester of polyglycerol, oil and fat for food, glycerol and, optionally according to desire, propylene glycol and water, heating the mixture at the temperature around 80° to 100° C. to melt the mixture and then kneeding the mixture while the mixture is rapidly cooled to a temperature of 25° C. or less. When the temperature of melting process is below 80° C., melting of decaglyceryl monostearate which is utilized as the fatty acid ester of polyglycerol may be incomplete.

Decaglyceryl monostearate which is preferably utilized as the fatty acid ester of polyglycerol is solid at the ambient temperature and is a hydrophillic surface active agent having the dropping point of 75° C. When decaglyceryl monostearate is melt and kneeded with oil and fat for food which is liquid at the ambient temperature, preferably MCT, and glycerol, an emulsion is considered to be formed. Thus, the thickness of the composition is enhanced and the composition is kept at a very viscous condition.

DESCRIPTION OF THE PREFERRED EMBODIMENTS

The invention will be understood more readily with reference to the following examples; however these examples are intended to illustrate the invention and are not to be construed to limit the scope of the invention.

The compositions prepared were evaluated by the following methods.

(1) Dropping point: dropping point in °C. is obtained by heating the sample at the rate of 2° C./min. by the method of measurement of dropping point according to Japanese Industrial Standard K-2220 5.4.

(2) Thickness: thicknewss after kneeding 60 times was obtained by the method according to Japanese Industrial Standard K-2220 5.3.

(3) Oxidation stability: oxidation stability in kgf/cm was obtained by the method of measurement of oxidation stability according to Japanese Industrial Standard K-2220 5.8. A larger value shows lower oxidation stability.

(4) Abrasion resistance and loading resistance: abrasion resistance in kgf and loading resistance in kgf were obtained by the method of Measurement of Extreme-Pressure Properties of Lubricating Grease (Four-ball Method) according to ASTM D 2596-87. A larger value shows better property, in both measurements.

(5) Safety for food sanitation: when the composition is made of approved food additives and foods, the mark O is shown and when the composition is made of other materials, the mark X is shown.

EXAMPLES 1 THROUGH 8, COMPARATIVE EXAMPLES 1 THROUGH 7

Components shown in Table 1 were charged in a beaker. The mixture was heated in a water bath or on a hot plate while it was stirred. When the mixture melted completely to become homogeneous, it was preliminarily emulsified for 10 to 15 minutes and then kneaded under rapid cooling until the temperature of the mixture became 25° C. or less. After leaving the mixture standing for 3 hours or more, a greasy oil and fat composition was prepared.

Properties of the composition thus prepared were evaluated. Results of the evaluation are shown in Table 1. Components are abbreviated in Table 1 as following: DGMS: decaglyceryl monostearate; MCT: triglyceride of medium chain saturated fatty acids; and PG: propylene glycol.

The results of evaluation shown in Table 1 clearly show that the compositions favorable as greasy oil and fat composition for food processing machines were prepared when 25 to 43 weight % of DGM, 3 to 25 weight % of MCT and 40 to 67 weight % of glycerol were utilized.

While the invention has been particularly shown and described with reference to preferred embodiments thereof, it will be understood by those skilled in the art that the foregoing and other changes in form and details can be made therein without departing from the spirit and scope of the invention.

To summarize the advantages obtained by the invention, the greasy oil and fat composition for food processing machines are safe for food sanitation, has excellent oxidation stability and lubricating property and are favorably utilized as lubricant for food processing machines.

TABLE 1

| | | Example | | | | | | | |
|---|---|---|---|---|---|---|---|---|---|
| | | 1 | 2 | 3 | 4 | 5 | 6 | 7 | 8 |
| composition, | DGMS | 26 | 30 | 40 | 30 | 30 | 35 | 30 | 30 |

TABLE 1-continued

| | | | | | | | | | |
|---|---|---|---|---|---|---|---|---|---|
| weight % | MCT | 10 | 10 | 10 | 3 | 15 | 25 | 10 | 10 |
| | glycerol | 64 | 60 | 50 | 67 | 55 | 40 | 60 | 60 |
| | PG | — | — | — | — | — | — | 2 | — |
| | water | — | — | — | — | — | — | — | 2 |
| properties | dropping point, °C. | 84.2 | 90.7 | 81.8 | 80.0 | 81.5 | 80.0 | 83.0 | 94.6 |
| | thickness | 254 | 241 | 215 | 230 | 235 | 213 | 237 | 239 |
| | oxidation stability, kgf/cm | 0.8 | 0.7 | 0.8 | 0.7 | 0.6 | 0.5 | 0.7 | 0.7 |
| | abrasion resistance, kgf, LW | 27.1 | 25.1 | 26.0 | 23.4 | 28.0 | 29.5 | 24.5 | 23.8 |
| | loading resistance, kgf, WL | 160 | 160 | 160 | 126 | 160 | 160 | 126 | 126 |
| | safety | ○ | ○ | ○ | ○ | ○ | ○ | ○ | ○ |

| | | Comparative example | | | | | | |
|---|---|---|---|---|---|---|---|---|
| | | 1 | 2 | 3 | 4 | 5 | 6 | 7 |
| composition, weight % | DGMS | 20 | 45 | 30 | 35 | 30 | general use grease | |
| | MCT | 10 | 10 | 2 | 30 | 10 | | |
| | glycerol | 70 | 45 | 68 | 35 | 60 | #1 | #2 |
| | PG | — | — | — | — | 3 | | |
| | water | — | — | — | — | — | | |
| properties | dropping point, °C. | 44.4 | 71.8 | 77.5 | 76.0 | 79.7 | 97.0 | 102 |
| | thickness | 273 | 208 | 223 | 219 | 240 | 312 | 268 |
| | oxidation stability, kgf/cm | 0.9 | 0.7 | 1.2 | 0.9 | 1.0 | 0.7 | 0.7 |
| | abrasion resistance, kgf, LW | 21.2 | 24.8 | 20.8 | 26.8 | 24.5 | 23.5 | 25.2 |
| | loading resistance, kgf, WL | 126 | 126 | 126 | 160 | 126 | 126 | 160 |
| | safety | ○ | ○ | ○ | ○ | ○ | X | X |

What is claimed is:

1. A greasy oil and fat composition for food processing machines wherein the greasy oil and fat composition is prepared by mixing 25 to 43 weight percent of the fatty acid ester of polyglycerol, 3 to 25 weight percent of oil and fat for food and 40 to 67 weight percent of glycerol, melting the mixture by heating and kneading the mixture.

2. A greasy oil and fat composition for food processing machines as claimed in claim 1 wherein the oil and fat for food is a triglyceride of a medium chain saturated fatty acid.

3. A greasy oil and fat composition for food processing machines as claimed in claim 2 wherein 25 to 35 weight percent of the fatty acid ester of polyglycerol, is employed.

4. A greasy oil and fat composition for food processing machies as claimed in claim 2 wherein 25 to 35 weight percent of the fatty acid ester of polyglycerol, 5 to 20 weight percent of a triglyceride of a medium chain saturated fatty acid and 50 to 65 weight percent of glycerol is employed.

5. A greasy oil and fat composition for food processing machines as claimed in claim 2 wherein the triglyceride of a medium chain saturated fatty acids is a triglyceride of a saturated fatty acid having 6 to 10 carbon atoms.

6. A greasy oil and fat composition for food processing machines as claimed in claim 2 wherein the triglyceride of a medium chain saturated fatty acid is a triglyceride of caproic acid, heptylic acid, caprylic acid, nonylic acid or capric acid.

7. A greasy oil and fat composition for food processing machines as claimed in claim 2 wherein the triglyceride of a medium chain saturated fatty acid is a triglyceride of caprylic acid and/or capric acid.

8. A greasy oil and fat composition for food processing machines as claimed in claim 2 wherein the fatty acid ester of polyglycerol is a fatty acid ester of decaglycerol.

9. A greasy oil and fat composition for food processing machines as claimed in claim 2 wherein the fatty acid esters of a polyglycerol are stearic esters of a polyglycerol.

10. A greasy oil and fat composition for food processing machines as claimed in claim 2 wherein the fatty acid ester of polyglycerol is stearic monoester of polyglycerol.

11. A greasy oil and fat composition for food processing machines as claimed in claim 2 wherein the fatty acid ester of polyglycerol is decaglyceryl monostearate.

12. A greasy oil and fat composition for food processing machines as claimed in claim 2 having a propylene glycol or water content of 2 weight percent or less.

13. A greasy oil and fat composition for food processing machines as claimed in claim 2 wherein the fatty acid ester of polyglyceride is stearic monoester of polyglycerol and the triglyceride of a medium chain saturated fatty acid is a triglyceride of caprylic acid and/or capric acid.

14. A greasy oil and fat composition for food processing machines as claimed in claim 3 wherein the fatty acid ester of polyglyceride is stearic monoester of polyglycerol and the triglyceride of a medium chain saturated fatty acid is a triglyceride of caprylic acid and/or capric acid.

15. A greasy oil and fat composition for food processing machines as claimed in claim 4 wherein the fatty acid ester of polyglyceride is stearic monoester of polyglycerol and the triglyceride of a medium chain saturated fatty acid is a triglyceride of caprylic acid and/or capric acid.

16. A greasy oil and fat composition for food processing machines as claimed in claim 7 wherein the triglyceride of a medium chain saturated fatty acid is a triglyceride of a mixed fatty acid comprising 50 to 95 weight percent of caprylic acid and 5 to 50 weight percent of capric acid.

* * * * *